US011097334B2

(12) United States Patent
Otto

(10) Patent No.: US 11,097,334 B2
(45) Date of Patent: Aug. 24, 2021

(54) FORGING HAMMER HAVING AN ELECTRIC LINEAR DRIVE

(71) Applicant: Langenstein & Schemann GmbH, Coburg (DE)

(72) Inventor: Markus Otto, Lautertal (DE)

(73) Assignee: LANGENSTEIN & SCHEMANN GMBH, Coburg (DE)

( * ) Notice: Subject to any disclaimer, the term of this patent is extended or adjusted under 35 U.S.C. 154(b) by 206 days.

(21) Appl. No.: 15/563,491

(22) PCT Filed: Mar. 29, 2016

(86) PCT No.: PCT/EP2016/056805

§ 371 (c)(1),
(2) Date: Sep. 29, 2017

(87) PCT Pub. No.: WO2016/156319

PCT Pub. Date: Oct. 6, 2016

(65) Prior Publication Data

US 2018/0085820 A1 Mar. 29, 2018

(30) Foreign Application Priority Data

Apr. 2, 2015 (DE) ..... 102015105172.9

(51) Int. Cl.
*B21J 7/30* (2006.01)
*B30B 1/42* (2006.01)

(52) U.S. Cl.
CPC .. *B21J 7/30* (2013.01); *B30B 1/42* (2013.01)

(58) Field of Classification Search
CPC .... B21J 7/30; B30B 1/42; H02K 7/14; H02K 41/031

(Continued)

(56) References Cited

U.S. PATENT DOCUMENTS 3,709,083 A 1/1973 Doherty
5,357,779 A * 10/1994 Hahn ..... B21D 22/28 72/347

(Continued)

FOREIGN PATENT DOCUMENTS

CN 2093048 U 1/1992
DE 1654160 8/1970

(Continued)

OTHER PUBLICATIONS

German Office Action for application No. 102015105172.9, dated Mar. 8, 2019.

(Continued)

*Primary Examiner* — Teresa M Ekiert
(74) *Attorney, Agent, or Firm* — Workman Nydegger

(57) ABSTRACT

The basic invention relates, in particular, to a forging hammer, comprising an electric linear drive, having a linear rotor and a ram that is coupled to the latter for the purpose of executing forging motions, wherein the linear rotor and the ram are connected to each other through an interposed flexurally elastic decoupling structure that acts between the linear rotor and the ram, and the decoupling structure is realized and arranged to decouple the linear rotor, at least partly, from relative motions of the ram relative to the linear rotor that occur during a forging motion.

20 Claims, 7 Drawing Sheets

(58) Field of Classification Search
USPC ..... 72/430; 318/135
See application file for complete search history.

(56) References Cited

U.S. PATENT DOCUMENTS

| | | | | |
|---|---|---|---|---|
| 6,313,551 | B1 * | 11/2001 | Hazelton | H02K 41/03 310/12.24 |
| 6,466,119 | B1 | 10/2002 | Chester | |
| 7,633,189 | B2 * | 12/2009 | Iwasa | H02K 41/03 310/14 |
| 7,752,880 | B2 * | 7/2010 | Sakamoto | B30B 1/00 100/35 |
| 7,944,096 | B2 * | 5/2011 | Wang | H02K 41/03 310/12.25 |
| 10,293,398 | B2 * | 5/2019 | Otto | H02K 41/031 |
| 2018/0297105 | A1 * | 10/2018 | Otto | H02K 41/031 |

FOREIGN PATENT DOCUMENTS

| | | |
|---|---|---|
| DE | 2500605 | 7/1976 |
| DE | 2456481 | 10/2002 |
| DE | 102008059607 | 6/2010 |
| EP | 1892084 | 2/2008 |
| GB | 2076718 | 12/1981 |
| KR | 20140066097 | 5/2014 |
| KR | 101462561 | 11/2014 |
| PL | 65677 Y1 | 11/2011 |
| WO | 2016156319 | 6/2016 |

OTHER PUBLICATIONS

Doege, Eckart; Behrens, Bernd-Arno: Handbuch Umformtechnik. 2. bearbeitete Auflage. Heidelberg [et al] : Springer, 2010. 719-730.—ISBN 978-3-642-04249-2.

International Search Report and Written Opinion for application No. PCT/EP2016/056805 dated Oct. 18, 2016.

* cited by examiner

FORGING HAMMER HAVING AN ELECTRIC LINEAR DRIVE

CROSS-REFERENCE TO RELATED APPLICATIONS

The present invention is a 35 U.S.C. § 371 U.S. National Stage Application corresponding to PCT Application no. PCT/EP2016/056805, filed on Mar. 29, 2016, which claims the benefit of priority to German Patent Application No. 102015105172.9 filed Apr. 2, 2015, the entire content of each of the aforementioned patent applications is incorporated herein by reference.

BACKGROUND OF THE INVENTION

1. Field of the Invention

The basic invention relates to a forging hammer having an electric linear drive.

2. Background

A forging hammer having linear drive is known, for example, from DE 20 2008 018 169 U1. In the case of the known forging hammer, a hammer ram is realized as a linear rotor of a linear motor, and has magnets, or secondary parts, attached thereto, which, together with the hammer ram, are accommodated in a longitudinally displaceable manner in a primary part realized in a stationary manner. For the purpose of executing forging motions, the hammer ram, realized as a linear rotor, is moved up and down by corresponding operation of the linear motor, such that forging operations can be executed at the bottom point of the downward motion.

The known forging hammer definitely leaves room for improvements and variations in respect of the development and design of the linear drive and hammer ram.

To that extent, it may be regarded as an object of the present invention to further develop the known forging hammer, in particular to specify alternative and/or improved embodiments of a forging hammer having linear drive.

This object is achieved according to the invention, in particular, by the features of claim 1 and claim 12. Further solutions, developments and variants of the invention are given, in particular, by the dependent claims and by the following description of exemplary embodiments.

BRIEF SUMMARY OF THE INVENTION

Developments according to claim 1 provide a forging hammer that comprises an electric, in particular electromagnetic, linear drive, having a linear rotor and a ram or hammer ram that is coupled to the latter, i.e. to the linear rotor, for the purpose of executing forging motions.

Within the meaning of the present application, an electric linear drive is to be understood to mean, in particular, an electric linear motor, in particular working electromagnetically, in which the linear rotor is guided, or mounted, in a stator that, in particular, is immovably fixed to a forging hammer frame, for the purpose of executing a rectilinear translational motion, in particular in the longitudinal direction of the linear rotor. For example, it may be a permanent-magnet-excited linear motor, in particular a solenoid linear motor. As a linear motor, this may be realized, for example, as a synchronous linear motor, for example of a cylindrical design, e.g. having a stator realized in the shape of a cylinder, and having a central, cylindrical through-hole in which a cylindrical linear rotor is guided. To that extent, the linear motor may be a tubular linear motor that works, or that can be operated, electromagnetically.

In the case of the proposed forging hammer, it is provided that the linear rotor and the ram are connected to each other through an interposed decoupling structure that acts indirectly and/or directly between the linear rotor and the ram. In particular, the decoupling structure may be realized and arranged to indirectly and/or directly decouple, in particular to decouple in a flexurally elastic manner, the linear rotor and the ram, this being particularly advantageous, in particular in the case of an electromagnetic linear motor, in particular a permanent-magnet-excited linear motor as comprised by the invention described herein. For example, a mechanical load acting on the rotor and/or stator during operation, e.g., in the form of longitudinal, transverse, torsional and/or shear vibrations, can be reduced by a decoupling structure. Thus, in particular, dependable running of the linear motor and associated reliable forging results can be achieved.

The decoupling structure, for example in the form of a two-dimensionally or three-dimensionally realized connecting structure having elastomechanical properties, may be realized and arranged such that the linear rotor can be decoupled, at least partly, in particular by elastomechanical absorber mechanisms, from relative motions of the ram relative to the linear rotor that occur during a forging motion.

Relative motions are to be understood to mean, in particular, such motions of the ram relative to the linear rotor that occur and are caused in association with the primary upward and downward motion, or back and forth motion, of the ram and/or during forging, in particular as a result of the primary motion and/or forging actions during operation of the forging hammer. The primary motion as such may be considered as a synchronous motion of the linear rotor and ram. To that extent, relative motions of the ram that differ therefrom may also be referred to as secondary motions of the ram.

Possible relative motions or secondary motions are, in particular, tilting motions, deformations, bending motions, vibrations and/or displacements of the ram transverse to the direction of motion of the linear rotor, and/or tilting motions, deformations, bending motions, vibrations and/or displacements occurring with respect to the longitudinal axis or central axis of the linear drive.

Owing to the interposed, in particular flexurally elastic or elastomechanical decoupling structure between the linear rotor and the ram, the linear rotor and the ram are, or can be, decoupled from each other, at least partly, preferably entirely, in respect of the secondary motions that occur for instance on the ram, during operation. In particular, a corresponding decoupling structure makes it possible to achieve extensive elastomechanical decoupling between the linear rotor and the ram, with the result that less stringent requirements are needed for the mechanical strength of the components used in the linear motor.

In particular, it is possible, at least to a large extent, to prevent secondary motions of the ram from being transmitted to the linear rotor, which would have a disadvantageous effect upon the drive and the driving characteristics of the linear drive. In addition, decoupling of the ram and linear motor, in particular the linear rotor, enables mechanical loads actually acting on the linear rotor during operation to be reduced. In particular, a magnetization structure of permanent magnets, realized on or in the linear rotor, can be prevented from being fully exposed to the mechanical loads, in particular impacts, that occur during the forging operation.

An, in particular elastomechanical, decoupling, or compensation of relative motions, can be achieved, in particular, in that the decoupling structure, or at least a portion of the decoupling structure, is realized so as to be deformable in a flexurally elastic, in particular vibrationally and/or torsionally elastic, manner, and can be deformed accordingly for the purpose of compensation, such that a transmission of the respective secondary motion of the ram to the linear rotor can be avoided or damped, at least to a large extent. To that extent, the decoupling structure may be a damping structure that acts elastomechanically.

The decoupling structure may comprise decoupling segments or decoupling regions that are each realized or arranged specifically for differing types of secondary motion, e.g., tilting motions relative to the longitudinal axis, displacements transverse to the longitudinal axis, transverse vibrations with respect to the longitudinal axis. For example, a decoupling region may comprise one or more tapers, indentations, beads, openings, recesses, longitudinal and/or transverse grooves, cavities, etc.

As already mentioned, the provision of a, in particular flexurally elastic, decoupling structure can achieve the effect that any secondary motions of the ram, such as vibrations, displacements, deformations and/or tilting motions are not, or at least substantially not, transferred to the linear rotor. In connection with this, it must be mentioned that the present invention is based, in particular, on the recognition that, in the case of forging hammers that have an electric linear drive and that do not have a decoupling structure, the said secondary motions can have the result of negatively affecting the running, in particular linear running, of the linear rotor in the assigned stator.

For example, as a result of even a partial transmission of secondary motions of the ram to the linear rotor, it can happen that, during the forging operation, an air gap realized between the linear rotor and the stator of the electric linear drive becomes altered or varies over the axial length of the stator, which can entail negative effects for the driving, and consequently forging, characteristics of the forging hammer, and potentially result in damage to the linear rotor and/or to the stator. By provision of a, in particular elastomechanical, decoupling structure acting in one, two or three dimensions, the said impairments can advantageously be avoided.

With regard to the term flexurally elastic decoupling structure, it must be noted that the term "flexurally elastic" within the meaning of the present application is to be understood, in particular, as a relative mass, in relation to the flexural elasticity of the material of the ram and/or of the linear rotor and/or of components immediately adjacent to the decoupling structure and/or in relation to differing portions of the decoupling structure as such, in that the decoupling structure or a portion thereof may have a specifically greater, in particular elastomechanical, flexural elasticity than the material of the ram and/or of the linear rotor and/or of the components immediately adjacent to the decoupling structure, and/or in that at least the portion of the decoupling structure may have a specifically greater flexural elasticity than other portions of the decoupling structure or adjoining regions.

A flexural elasticity that is specifically greater than adjacent or adjoining components or portions may be implemented, or able to be implemented, in that, relative to the adjacent or adjoining components, the decoupling structure may be tapered or have a taper, at least portionally, in a direction transverse to, in particular perpendicular to, the direction of motion of the linear rotor. A corresponding taper may have, for example, a concave curvature realized in the cross section along the direction of motion of the linear rotor, or a different shape.

A taper realized in connection with the decoupling structure may be formed, for example, in such a way that a diameter of the decoupling structure measured transversely in relation to the direction of motion of the linear rotor, in particular a portion of the decoupling structure, is smaller, by a factor of between 0.85 and 0.97, in particular by a factor of approximately 0.95, than a correspondingly measured diameter of an adjacent or adjoining component and/or of a further portion of the decoupling structure.

For example, there may be a taper portion, the diameter of which, transverse to the direction of motion of the linear rotor, is smaller, by a factor of between 0.85 and 0.97, in particular by a factor of approximately 0.95, than a maximum diameter of the decoupling structure measured transversely in relation to the direction of motion of the linear rotor.

Moreover, a flexural elasticity that is specifically greater than adjacent or adjoining components or portions of the decoupling structure may be achieved, or achievable, in that the surface area of cross sections or cross-sectional surfaces of the decoupling structure transverse to the direction of motion is or can be selectively varied.

In particular, the decoupling structure or a portion thereof may be realized, in its two-dimensional or three-dimensional geometrical structure in such a manner that the surface area of cross-sectional surfaces varies in a direction parallel to the direction of motion. For example, the two-dimensional or three-dimensional structure may have one or more tapers, indentations, beads, depressions, through-punches, openings, cavities, etc., which are realized such that, in a direction parallel to the direction of motion, surface areas of cross-sectional surfaces of the decoupling structure lie, or vary, between a maximum and a minimum value. A reduction of the surface area relative to adjoining or adjacent components or portions may be in the range, for example, of between 0.65 and 0.95, in particular approximately 0.90.

It must be noted at this point that a reduction of the surface area need not necessarily involve a reduction of the total diameter of the decoupling structure transverse to the direction of motion. In particular in the case of a three-dimensional structure having flexurally elastic resilient properties in the transverse direction and/or parallel to the direction of motion, a reduction of the cross-sectional area may be combined with an enlargement of the overall diameter. In particular, corresponding three-dimensional structures for the decoupling structure may be designed such that a comparatively small material fatigue is achieved, and thus a comparatively long service life can be achieved for the decoupling structure in operation with continual flexural elastic loading of the decoupling structure.

In developments, the decoupling structure may comprise a, in particular elastomechanically realized, flexurally elastic decoupling element that may be realized and arranged in such a manner that the linear rotor is decoupled, at least to a large extent, with respect to secondary motions of the ram, e.g. vibrations, displacements, deformations and/or tilting motions, occurring along and/or transverse to the longitudinal axis of the linear rotor during a forging motion.

The flexurally elastic decoupling structure may be realized, in particular, such that the aforementioned variation in the diameter and/or in the surface area of the cross-sectional surfaces is achieved, or implemented, over the course of the decoupling structure, parallel to the direction of motion of the linear rotor.

The decoupling structure may be realized as a single piece with the linear rotor, and may be realized, for example, at an end of a piston rod or piston-type rod or structure. It is also possible for the decoupling structure to be realized as a separate structural element, and to be connected in a form-fitting, materially bonded and/or force-fitting manner to the linear rotor and/or a piston thereof.

By means of a corresponding decoupling element, or also a plurality thereof, it can be achieved, for example, that secondary motions that may occur along and/or transverse to the direction of longitudinal motion of the linear rotor can be counteracted, such that during operation an advantageous geometry of the air gap between the linear rotor and the stator can be achieved, or maintained, for example by at least partial decoupling of the linear rotor and ram in respect of vibration. Moreover, by means of one or more decoupling elements, it is possible at least to reduce, for example to absorb, at least partly, the mechanical load, in particular vibrational load, of the linear rotor during operation of the forging hammer, in particular in such a manner that damage to the linear rotor, and potentially to permanent magnets attached thereto or therein.

In developments, it may be provided that the forging hammer furthermore comprises a first linear guide, or linear bearing arrangement, which is realized between the stator of the linear drive and the ram, in particular in alignment with the central axis of the linear drive, and in which the linear rotor is guided and carried in the longitudinal direction.

The first linear guide may be, for example, a bearing such as, for example, a rolling bearing or sliding-contact bearing, in particular a sliding bushing or guide bushing, by which the linear rotor is mounted so as to be movable in the axial direction, and can be supported transversely to the axial direction, in particular without play or largely without play.

Provision of such a first linear guide makes it possible, by action in combination with the decoupling structure, to achieve, in particular, stabilization of the axial running of the linear rotor, in particular of the axial position of the linear rotor in the stator. For example, excursions occurring transversely to the axial direction that may occur during operation of the forging hammer, for instance on the linear rotor as a result of secondary motions of the ram, can at least be counteracted, supporting the decoupling structure. Stabilization of the position and running of the linear rotor can also achieve the effect that the geometry, shape and/or width of the air gap formed between the linear rotor and the stator is stabilized during the forging operation, and variations in the air gap geometry that are caused by forging operations can be at least suppressed, or at least largely avoided. This results, in particular, in improved driving characteristics of the linear drive, and consequently, at least indirectly, in improved forging results.

According to a further development, it may be provided that the forging hammer furthermore comprises a second linear guide, on a side of the linear drive that faces away from the ram, in which or by which the linear rotor is guided in the longitudinal direction and, in particular, is supported transversely to the longitudinal direction.

The second linear guide may be realized, for example, as a guide bushing, bearing or similar, and in particular may be connected to or on a housing or a carrying structure and/or the stator, or fastened thereto. The second linear guide may be realized, for example, as a type of bushing or sleeve, in particular closed on one side, in which a corresponding part or portion of the linear rotor can be guided during operation of the forging hammer. In developments, it may be provided that a length of the bushing or sleeve, measured in an axial direction, i.e. parallel to the direction of motion of the linear rotor, is at least as great as one times the diameter of the linear rotor.

By means of the second linear guide, it can be achieved that on the one hand the linear rotor is mounted so as to be movable in an axial direction, and on the other hand the linear rotor is supported or carried, in particular without play or largely without play, transversely to the axial direction.

A particularly stable running of the linear rotor can be achieved if the electric linear drive has both the first and the second linear guide. In other words, it is advantageous, in particular, if the linear rotor is mounted axially on both sides of the stator, on the one hand in the first linear guide that faces toward the ram, and on the other hand in the second linear guide that faces away from the ram.

In particular, the linear rotor, the first linear guide and the second linear guide may be realized, and realized relative to each other, in such a manner that the linear rotor is always guided and supported, both in the first and in the second linear guide, over an entire linear motion cycle. The linear rotor, the first linear guide and the second linear guide may be realized in such a manner that a first axial end region of the linear rotor that faces toward the ram in the mounted state is always guided in the first linear guide, and a second axial end region that faces away from the ram in the mounted state is always guided in the second linear guide.

In particular, through combined action of the first and the second linear guide, it can be achieved that the linear rotor and the stator are disposed in alignment with each other, in the case of a cylindrical linear motor concentrically, i.e. in axial alignment, with each other, at least over the respective overlap region of the linear rotor and stator. It can thus be achieved that variations of the air gap are largely prevented.

By use of the first and the second linear guide, it is possible to implement a linear drive, having a linear motor, in which the linear rotor is guided in a central rotor space, e.g. in the form of a through-bore or through-opening, of a stator having a hollow-cylinder geometry, the first and the second linear guide being disposed at axial end faces or front ends of the stator that face away from each other, such that guide elements, for example guide bushings, for the first and the second linear guide are in axial alignment with the rotor space.

In particular in the case of developments in which the stator and linear rotor have a cylindrical geometry, the width of the air gap measured between the linear rotor and the stator may be, for example, 2 mm.

In developments, the first and/or second linear guide may be present or realized in or on a supporting or carrying structure for a linear motor of the electric linear drive. In particular, the first and/or second linear guide may be present or realized on or in a housing structure for an electric linear motor of the electric linear drive. The supporting or carrying structure may be, for example, constituent parts of the housing structure.

The housing structure may have, for example as a carrying element, for example a housing base, on which the stator of the linear motor is carried, in particular fixed and supported. The first linear guide may be realized in or on the housing base, and the first linear guide may be attached and fixed, at least partly, in a through-opening of the housing base, and the through-opening, in particular through-bore, may be realized in such a manner that it is realized in axial alignment with the rotor space, and during operation the linear rotor can be moved therein according to the respective linear motion. The first linear guide, for example a sliding-contact bearing structure, may be disposed so as to extend circumferentially along the through-opening, such that the sliding-contact bearing structure realizes a passage opening for the linear rotor that is concentric with the through-opening.

The second linear guide may be realized at an end face that faces away from the first linear guide, in particular at an end face of the housing or of the stator that faces away from the housing base. The second linear guide may comprise a guide cylinder provided with a supporting structure that is realized, for example, externally. The guide cylinder may be attached to a supporting or guide plate, and there may be supporting ribs, connecting the guide plate and the guide cylinder, for the purpose of mechanical stabilization.

Extending from the housing base, there may be supporting walls, to which the guide cylinder, in particular the guide plate can be fastened, which run on laterally opposite sides of the stator and parallel to the longitudinal direction of the linear motor. The supporting walls and the housing base may be braced against each other by one or more supporting ribs, in particular in such a manner that a deformation of the housing, in particular caused by torsional, shear and/or longitudinal vibrations, during the operation of the forging hammer can be prevented, at least to a large extent.

In developments, the housing may comprise a housing casing, which is fastened to the housing base and/or to the lateral supporting walls, and which is realized, when in the mounted state, to surround at least the stator of the linear motor. The housing casing may comprise one or more mutually connected housing casing elements that each respectively surround a portion of the stator of the linear motor in a protective manner. Preferably, the housing casing elements are separably connected to each other, for example by means of flanges that are disposed in a mutually corresponding manner and realized on mutually adjoining housing casing elements. The housing casing elements may comprise cylinders, cylinder shells or partial cylinder shells, for example cylinder half-shells, that are realized so as to be connectable to each other and to the housing base and/or to the supporting walls. A correspondingly modular structure of the housing offers advantages, in particular, in respect of any servicing works to be performed.

In developments, it may be provided that the housing, in particular the housing base, comprises, on a side that faces toward the ram, one or more stop buffers that are realized in such a manner that, in the case of an, in particular exceptional, collision between the ram and the housing, the mechanical load on the linear motor caused by the collision can at least be weakened, or buffered.

In developments, the housing as such, with the linear motor fastened in and on the housing, may be attached to an underframe of the forging hammer. The underframe may have a ram guide, realized between the underframe and housing and arranged to guide the ram linearly, which is realized on or in the underframe and/or is mechanically connected thereto. The ram guide is advantageously connected to the underframe in such a manner, and the linear motor and the housing are preferably connected to the underframe in such a manner, that the linear motor is mechanically decoupled, at least to a large extent, in respect of the mechanical connection that exists, via the underframe, between the linear drive and the ram and the ram guide. For this purpose, interposed absorber or damping elements or structures may be provided, for example, between the underframe and the linear drive.

In particular, with the structure proposed herein it is possible for direct and/or indirect mechanical connections that exist between the linear drive and the ram to be decoupled with respect to the transmission of impacts and/or vibrations. In this way, it can be achieved, in particular, that during the forging operation the linear motor is subjected to comparatively little mechanical loading, with the result that, on the one hand, the stress on the material of components of the linear motor can be reduced by mechanical decoupling and, on the other hand, reliable operation of the linear motor can be ensured in that variations of the air gap realized between the stator and linear rotor that result from the mechanical decoupling can be avoided, at least to a large extent, during operation.

According to one development, the linear rotor, at least in the region of connection to the decoupling structure, and/or the decoupling structure as such may have a piston type, in particular piston-rod type, cylinder structure.

The decoupling structure may be designed in such a manner that the flexural strength is reduced in relation to components or elements of the forging hammer that directly adjoin or are connected to the decoupling structure, in particular is less, by a factor, than the flexural strength of the adjoining components and/or elements.

In particular in developments having a linear rotor realized in the manner of a cylinder or in the manner of a piston, for example in the form of a piston rod, it may be provided that an axial length of the first and/or second linear guide, in particular of guide surfaces of the first and/or second guide, measured in the direction of motion of the linear rotor, is at least as great as one times the diameter of the linear rotor, in particular in the region interacting respectively with the first or second linear guide. In brief, in the corresponding designs, the axial length of the first and/or second linear guide may be at least one times the diameter of the corresponding portion of the linear rotor.

In developments, it may be provided that a ratio of a diameter of the cylinder structure to the length of the decoupling structure realized between the linear rotor and the ram is in the range of between ⅕ and ½. By corresponding or appropriate setting of the length and/or diameter of the cylinder structure realized between the linear rotor and the ram, in particular the flexural strength, or alternatively the flexural elasticity, can be altered and set in a selective manner.

In developments, it may be provided that the decoupling structure is realized between the linear rotor, or a spur adjoining the linear rotor, and a fastening structure realized to fasten the ram to the linear rotor.

The fastening structure may be realized, for example, as a wedge segment or conical segment that can be connected in a form-fitting or frictional manner to the ram, in particular engaging in the ram in the axial direction. In particular in the case of corresponding wedge-segment or conical segment connections, a comparatively robust and reliable connection between the ram and linear rotor can be achieved by provision of the decoupling structure.

In developments, in particular as claimed in claim 12, a forging hammer may be provided, which may be realized, for example, according to the developments described above and below, and which comprises an electric linear drive, or the electric linear drive, having a linear rotor, or the linear rotor. The linear rotor may comprise a magnetic portion, extending in the axial direction, that is composed of a plurality of permanent magnets disposed in succession in the axial direction.

The magnetic portion may be adjoined, in the extension thereof, at an axial end of the linear rotor, by, for example, a cylindrical spur, on or in which, for example, the decoupling structure, or a decoupling structure as described herein, and/or the fastening structure, or a fastening structure as described herein, realized for fastening to the ram, may be realized.

In developments, the permanent magnets of the magnetic portion may be realized as magnetic annular disks, and disposed in succession in axial alignment. In this arrangement, a cylindrical magnetic portion can be achieved, which can be guided, for example, in a cylindrical rotor space of a stator having a hollow-cylinder geometry.

In developments having a magnetic portion composed, at least partly, of magnetic annular disks, the linear rotor may have a central piston rod that goes through central through-holes of the magnetic annular disks. In other words, the magnetic annular disks can be put onto or threaded onto a piston rod, such that the piston rod goes through the through-holes and the magnetic annular disks are disposed in axial alignment with each other. The piston rod and the magnetic annular rings may be regarded, as it were, as a cylindrical magnetization structure for the linear rotor.

By means of the piston rod, the magnetic annular disks can be fixed, or become fixed, to the linear rotor, oriented in and transversely to the longitudinal direction. Accordingly, in developments, existing or attached fastening elements, for example clamping nuts, may be provided on both sides, for example at an end, of the magnetic portion. The fastening elements and the piston road may be designed, for example, such that the permanent magnets and piston rod can be clamped to each other by the fastening elements, for example for the purpose of improving the mechanical stability.

In further developments, the permanent magnets may be provided and disposed in the magnetic portion or have a configuration according to which the permanent magnets are magnetized alternately radially and axially in succession in the axial direction. Such a magnetization structure, having alternately succeeding radial magnetization and axial magnetization, has proved to be particularly advantageous in respect of use in the case of a forging hammer, in particular with use of a stator having a hollow-cylinder geometry.

In developments, shims, in particular laminated shims, may be disposed between axially succeeding permanent magnets. Such shims, for example in the form of high-grade steel shims, may be interposed, for example, for the purpose of compensating production tolerances of the permanent magnets and/or setting a respective magnetization structure.

A linear rotor that is suitable for forging hammers can be realized, in particular, by the proposed structure of the magnetic portion, for example comprising permanent magnets having, in particular, an annular geometry, that are clamped to each other on the piston rod by interposed shims.

According to developments, a neodymium-iron-boron (NdFeB) material is preferably used as material for the permanent magnets. In particular, such materials have proved to be advantageous for the accelerations and actions of forces required in the case of forging hammers. However, the permanent magnets may also be produced from other materials, and in particular the permanent magnets may be realized as sintered bodies.

In further developments, the linear rotor may comprise at least one guide sleeve in a region adjacent to, preferably directly adjoining, the magnetic portion. Preferably, an outer surface of the guide sleeve forms a bearing surface, by means of which the linear rotor can be mounted, so as to be movable in the longitudinal direction, in the first or second linear guide. The guide sleeve in this case may be developed such that, for the purpose of supporting or mounting the linear rotor, it can lie, or be mounted in a sliding manner, with an outer surface against an inner surface of the linear guide.

For the purpose of improving the tribological properties of the guide sleeve, according to further developments the latter may have one or more sliding guide rings. Preferably, the outer diameter of the sliding guide rings is selected such that the latter can be accommodated in a sliding manner in a linear guide realized as a guide bushing, for example the second linear guide.

In developments, the guide sleeve may be realized such that only the guide sleeve is in contact with a corresponding guide surface, such that the guide surface to that extent may be regarded as a part of a linear bearing for the linear rotor.

According to developments, at an end of the magnetic portion that is opposite from the guide sleeve, a stop sleeve may be provided, which may be realized, in particular, to interact with a stop present at the first linear guide in order, for example, to limit the possible freedom of movement of the linear rotor in the longitudinal direction.

In particular, the linear rotor may be realized in such a manner that it is mounted, or can be mounted, at two regions that are spaced apart from each other in the longitudinal direction, preferably directly adjacent to the long-side ends of the magnetic portion.

It may be provided in developments that an outer surface, at least of the magnetic portion, is provided with a coating in order to protect at least the permanent magnets from external influences such as dirt, dust, moisture, etc. A resin, in particular an epoxy resin, or a material comprising a resin, may be used for the coating.

As already mentioned at a different point, the linear drive may be realized as a cylindrical, i.e. tubular, linear motor. In particular, in the case of such developments, the linear rotor, but at least the magnetic portion or the magnetized part of the linear rotor, has a cylindrical shape with preferably an approximately circular cross section. Accordingly, the stator may be realized with a cylindrical central passage opening.

In developments, the linear motor may be realized as a permanent-magnet-excited synchronous linear motor. With appropriate forging hammers, forging operations can be controlled in a comparatively exact and precise manner.

A travel path, or stroke, of the linear rotor may be, or example, between 700 mm and 800 mm, in particular approximately 750 mm. However, the invention proposed herein is also suitable for other strokes, in particular greater, but also lesser, strokes of the linear rotor.

In developments, a linear motor of the linear drive may have a modular structure parallel to the direction of motion of the linear rotor. For example, the linear rotor may have a predefined but variable number of permanent magnets disposed in succession. The stator may have, for example connected in succession parallel to the direction of motion, a respectively defined but variable number of magnet coils, for example each comprising a coil carrier and a corresponding coil winding. The housing may have, for example, one of the plurality of housing segments connected in succession. The modular structure makes it possible for the linear motor to be adapted flexibly according to the respective requirements and boundary conditions.

In developments, the linear motor may have a housing having a single-part or multi-part housing casing, in particular of a modular structure, which is supported on a housing base or a base plate. There may be reinforcing elements, in particular reinforcing ribs, between the base plate and the housing casing for the purpose of mechanical reinforcement.

In developments, the base plate may have a fastening interface, by means of which the linear motor can be attached to a carrying frame of the linear hammer. The base plate may be realized, in particular, in such a manner that differing fastening interfaces may be realized, for example on the underside thereof, such that it is possible to mount a respective linear motor on differing linear hammers.

In developments, the housing, in particular the base plate or the housing base, may be connected in a force-fitting manner to a carrying frame or to the carrying frame of the linear hammer. For example, screwed connections, for instance provided at respective corners of the base plate, may be used for fastening.

In developments, a corresponding screwed connection may comprise a damping element and/or damping bearing element, for example a metal-rubber bearing, for example between screw elements, for instance a screw head and/or nut.

In developments, the base plate or the housing base may be mounted on and fastened to the hammer frame by means of interposed damping or absorber strips.

In particular, damping elements and/or damping strips, and other damping or absorber components, that are present between the linear motor and the hammer frame are instrumental in decoupling the linear motor from the hammer frame, such that mechanical impacts, vibrations and the like that occur during forging operations can at least be weakened, such that a direct application of occurring mechanical forces to the linear motor can at least be reduced.

BRIEF DESCRIPTION OF THE DRAWINGS

Exemplary embodiments of the invention are described in greater detail in the following on the basis of the appended figures. There are shown.

DETAILED DESCRIPTION OF THE PREFERRED EMBODIMENTS

Figure 1:
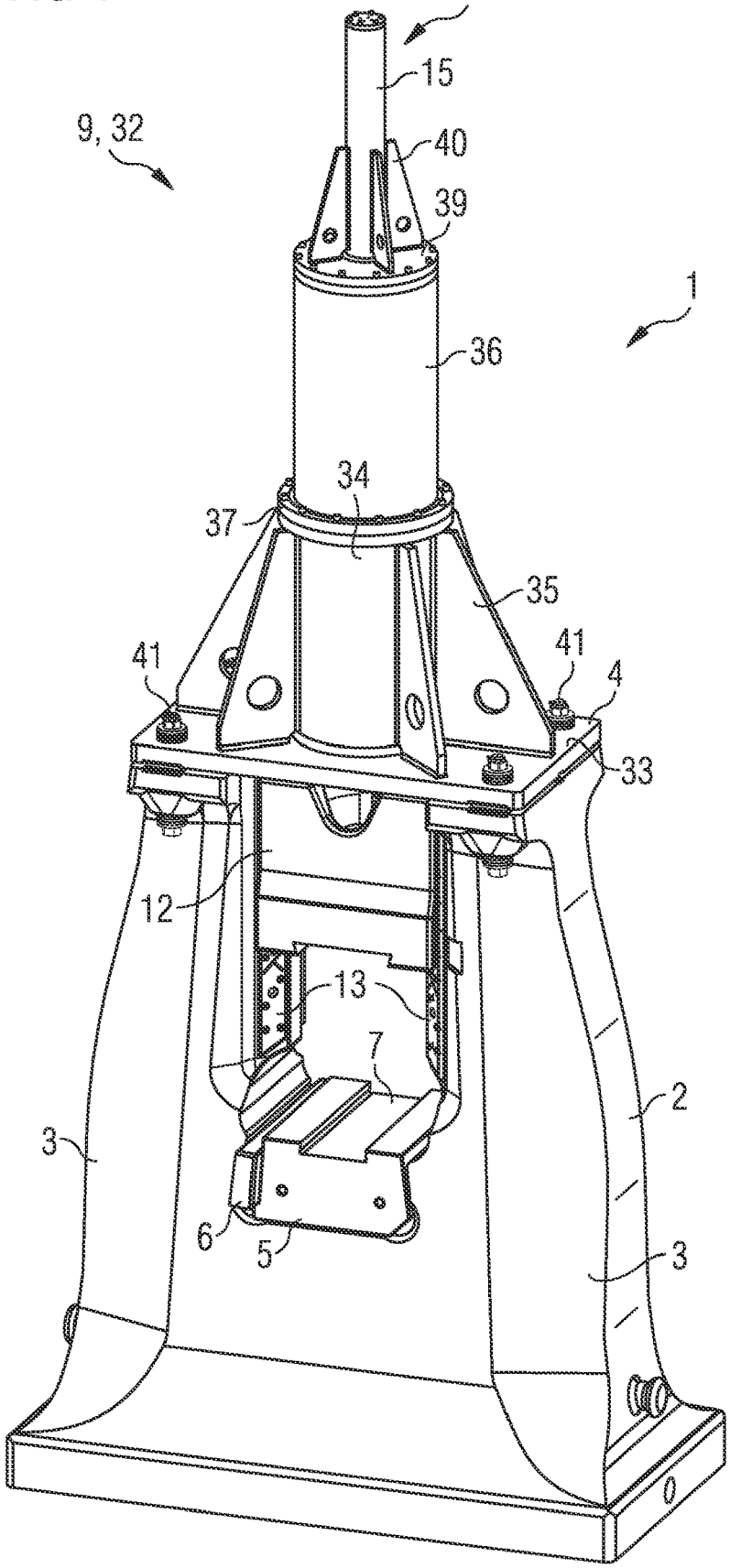
FIG. 1 provides a perspective view of a forging hammer.

FIG. 1 shows a perspective view of a forging hammer 1, with a hammer frame 2 having two lateral columns 3 for supporting a crosshead 4.

Figure 2:
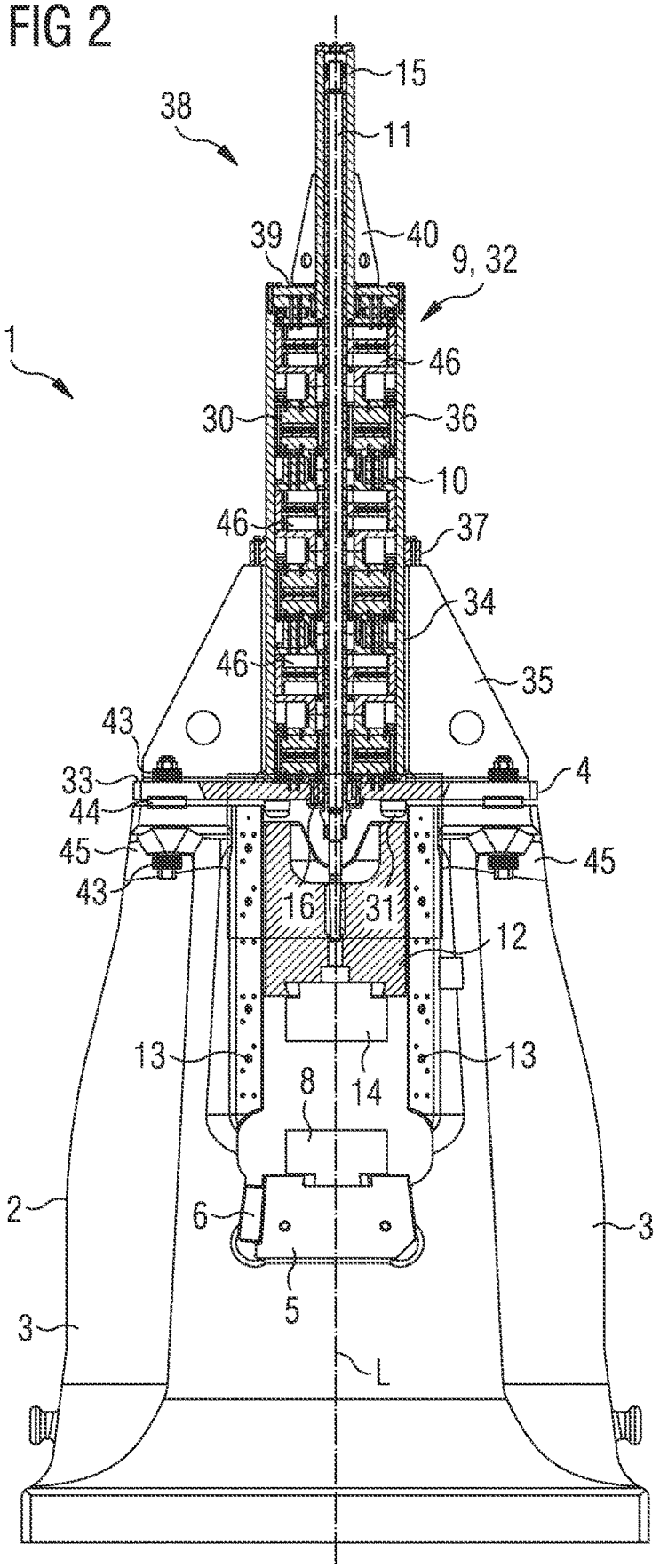
FIG. 2 provides a sectional representation of the forging hammer.

A forging hammer 1 as shown in FIG. 1 may comprise a lower insert 5 that can be fastened in the hammer frame by means of an insert wedge 6, and have a receiver 7 for a lower hammer die 8, which can be seen in FIG. 2 showing a sectional representation of the forging hammer 1.

The forging hammer 1 furthermore comprises a tubular solenoid linear motor 9, in particular a solenoid-permanently-excited synchronous linear motor, that is fastened to and supported on the upper crosshead 4.

The solenoid linear motor 9, realized as an electric linear drive, comprises a stator 10 and a linear rotor 11 guided therein in the longitudinal direction (see FIG. 2).

The linear rotor 11 is coupled to a ram 12, which in turn is guided in two ram guides 13 realized on the columns 3, such that the ram 12 can be moved up and down by the electric linear motor 9.

The solenoid linear motor 9 is accommodated in a housing 32. The housing 32 is of a modular structure and, in the example shown in the figures, comprises a housing base 33, having a cylindrical first housing casing 34 that is fastened and fixed hereto. The first housing casing 34 is connected, for example in a materially bonded manner, to the housing base 33, and mechanically reinforced with respect to the housing base 33 by means of first supporting ribs 35, or supporting angles.

The housing 32 furthermore comprises a cylindrical second housing casing 36, which is connected to the first housing casing 34, in the present example in a force-fitting manner, via a separable flanged connection 37.

A linear bearing arrangement 38, described in greater detail further below, which comprises a bottom plate 39 and a cylindrical guide bushing 15 fastened to the bottom plate 39, in particular in a materially bonded manner, is fastened to the side of the second housing casing that faces away from the first housing casing 34. The guide bushing 15 and bottom plate 39 are mechanically reinforced against each other by means of second supporting ribs 40, or supporting angles, attached thereto.

Since the housing 32 is of a structure that is mechanically comparatively stable, on the one hand electronic components of the solenoid linear motor 9 can be protected against mechanical effects. On the other hand, owing to the modular structure, components accommodated in the housing are rendered comparatively easily accessible, for example in the case of any necessary servicing works.

The solenoid linear motor 9 is connected to the underframe of the forging hammer 1, i.e. to the columns 3, by means of the housing base 33 of the housing 32. Specifically, the housing base 33 is screw-connected to T-shaped column heads of the columns 3. There may be positioning elements and/or dampers or absorber elements between the housing base 33 and the column heads. The dampers or absorber elements may be designed at least to damp a transmission of mechanical impacts or vibrations from the underframe to the housing 32.

As shown in FIG. 2, the ram 12 carries, fixed thereto, an upper hammer die 14 that corresponds to the lower hammer die 8.

When the forging hammer 1 is in operation, the ram 12 is moved up and down by corresponding driving of the linear rotor 11 by the solenoid linear motor 9, with respective forging operations being able to be performed on a workpiece (not shown) at lower bottom points of the ram 12.

As can be seen in particular from FIG. 2, the linear rotor 11 is realized in the manner of a piston rod, and is of a length, measured parallel to the longitudinal axis L, that is greater than the length of the stator 10 measured parallel to the longitudinal axis.

Figure 3:
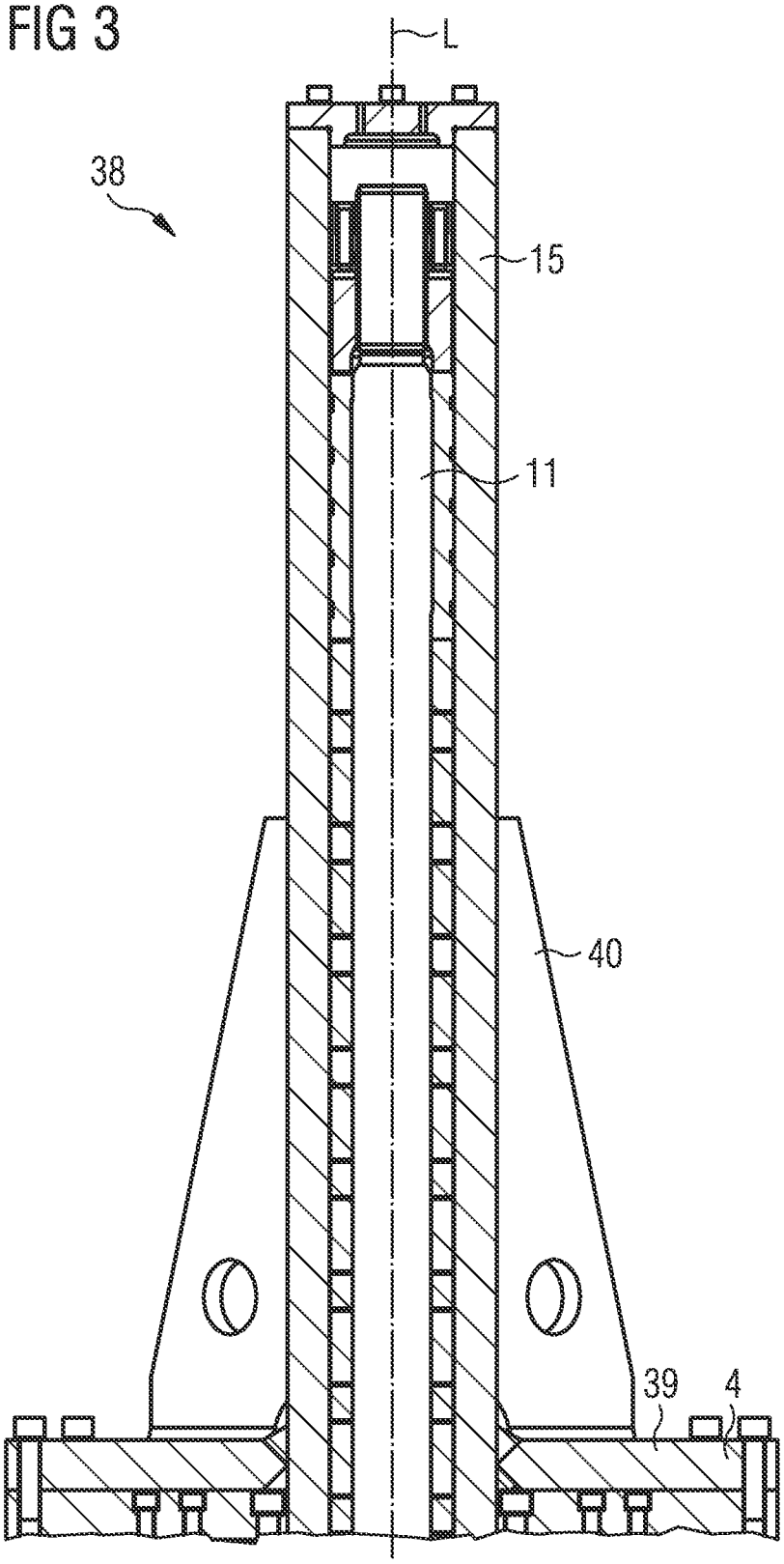
FIG. 3 provides a detail of the forging hammer according to FIG. 2.

As already described, at an upper end, i.e. at an end that faces way from the ram 12, the solenoid linear motor 9 has the guide bushing 15, which is shown in greater detail in the detailed representation of FIG. 3.

The guide bushing 15 is disposed in alignment and in the prolongation of the running axis, or guide axis L, of the solenoid linear motor 9, and is realized such that the linear rotor 11 is guided in the longitudinal direction and supported transversely to the longitudinal direction.

At a lower end of the solenoid linear motor 9 that faces away from the upper end there is a supporting bearing 16 that can be seen in greater detail in the representation of FIG. 3, which shows an enlarged detail of FIG. 2.

The supporting bearing 16 is disposed in alignment with the longitudinal axis L and in alignment in relation to the upper guide bushing 15, and is realized and arranged in such a manner that the linear rotor 11 is guided therein in the longitudinal direction, and supported transversely to the longitudinal direction.

Figure 4:
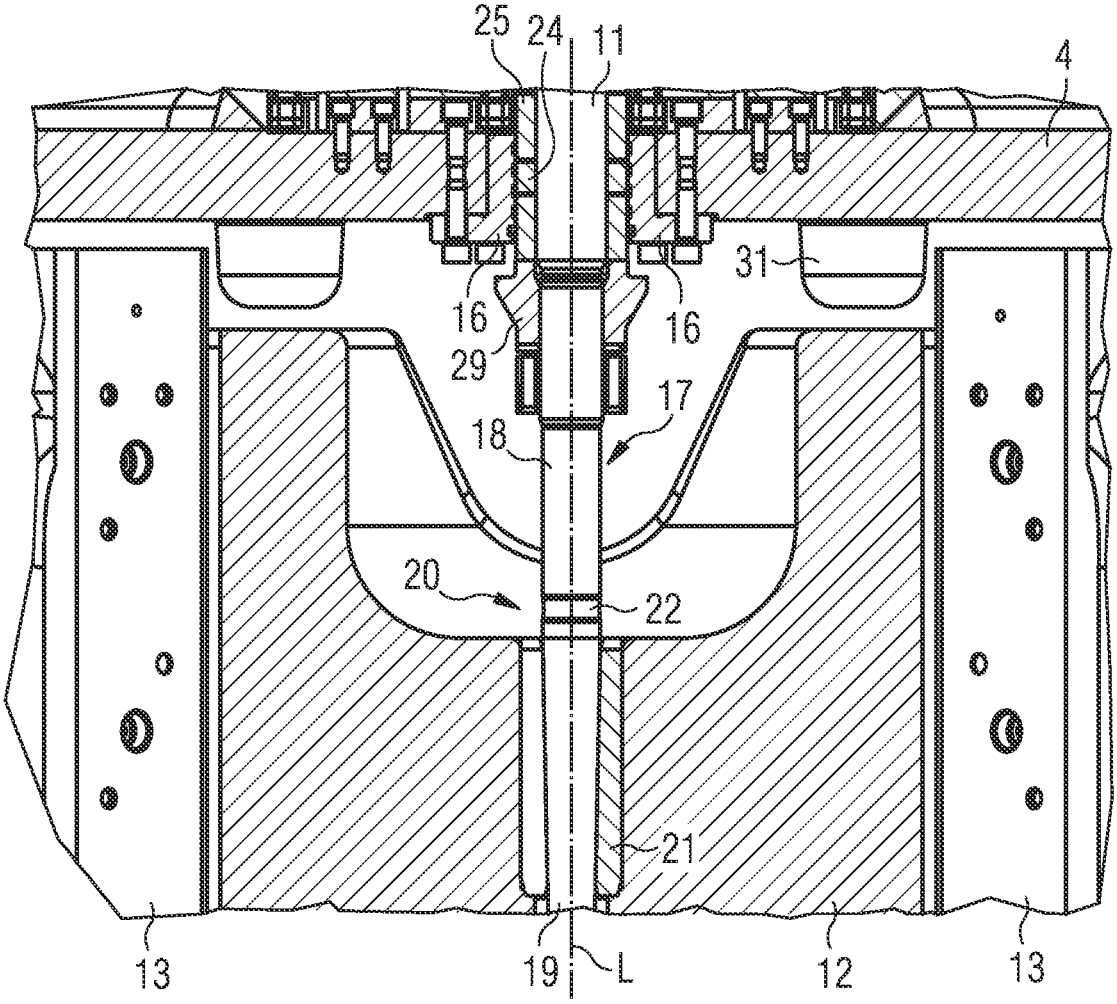
FIG. 4 provides further detail of the forging hammer according to FIG. 2.

At the end that faces toward the ram 12, the linear rotor 11 has a piston-rod extension 17, which, in the retracted position of the direction of motion, as shown in FIG. 2 and FIG. 4, extends between the supporting bearing 16 and the ram 12.

This piston-rod extension 17 comprises a piston portion 18, a fastening structure 19 provided at the distal end, and a decoupling structure 20 located between the piston portion 18 and the fastening structure.

The fastening structure 19 is realized in the form of a wedge or conically tapered portion, and is connected to the ram 12 in a form-fitting, in particular frictional, manner by means of a retaining bushing 21 in a corresponding recess, or a through-hole or blind hole of the ram 12.

The decoupling structure 20 comprises a flexurally elastic decoupling portion 22 disposed between the piston extension and the fastening structure 19. The decoupling portion 22 has a flexural elasticity that is greater than that of the adjacent components and materials.

The increased flexural elasticity, or reduced flexural stiffness, as compared with the adjacent or directly adjoining components or materials may be effected, for example, by one or more tapers realized in the region of the decoupling structure, for example having a concave structure with respect to the longitudinal axis L, by the use or provision of a correspondingly flexurally elastic material, by indentations, recesses, openings, etc.

In particular, a ratio between the diameter of the linear rotor 11, or a piston of the linear rotor, and the diameter of the decoupling structure 20, in each case measured transversely to the direction of motion of the linear rotor 11, may be in the range of approximately 0.95. Also possible, in particular, are ratios in the range of from 0.80 to 0.97, or alternatively 0.85 to 0.95, with which comparatively advantageous elasticity properties can be achieved for forging operations.

When the forging hammer 1 is in operation, during forging operations in which the ram 12 is moved up and down for the purpose of performing work on a workpiece, and in which, at a lower reversal point, forming of the workpiece is or can be effected, the guide bushing 15, the supporting bearing 16 and the decoupling structure 20 act in combination in such a manner that the linear rotor 11 and the ram 12 are decoupled with respect to relative motions of the ram 12 in relation to the linear rotor 11, and the linear rotor 11 is guided properly in the stator 10. In other words, through combined action of the guide bushing 15, supporting bearing 16 and decoupling structure 20, in particular of the decoupling portion 22, and dampers and/or absorber elements that may be present between the hammer frame 2 and the housing 32, secondary motions of the ram 12 are compensated or absorbed, in order thus to prevent, at least to a large extent, transmission to the linear rotor 11.

More precisely, the decoupling structure 20, in particular the decoupling portion 22 and/or the decoupling portion 22 and the piston portion 18, has the effect that secondary motions of the ram 12 that occur during a forging operation, for example in the form of tilting motions with respect to the longitudinal axis, displacements or vibrations transversely to the longitudinal axis, or the like, are not transmitted, or are not transmitted to their full extent, to the linear rotor 11.

The supporting bearing 16 and the guide bushing 15 act in respect of the position and the running of the linear rotor 11 in the stator 10, and to stabilize an air gap realized between the linear rotor 11 and the stator 10, inside the linear motor 9, and in particular are instrumental in avoiding a transmission of secondary motions of the ram 12 to the linear rotor 11.

The proposed measures, i.e. in particular the provision of the decoupling structure 20, the lower supporting bearing 16 and the upper guide bushing 15 enable the linear rotor 11 to be guided in an optimum manner in the stator 10. In particular, owing to the stabilization of the linear rotor 11 and its mechanical decoupling from the ram 12, it is possible to avoid the geometry of the air gap, realized between the linear rotor 11 and the stator 10 inside the solenoid linear motor 9, being influenced, in particular varied, by forging motions. Changes in the air gap during operation of the linear motor have a disadvantageous effect on the operation of the solenoid linear motor 9, which in turn can result in impairments in the forging result and/or in reduced energy efficiency. In other words, in particular owing to the decoupling structure 20, and owing to the combined action and the interaction with the linear guides realized as a guide bushing 15 and supporting bearing 16, it can be achieved that the position of the linear rotor 11 is stabilized during the forging operation, and is at least largely independent of secondary motions of the ram 12.

Figure 5:
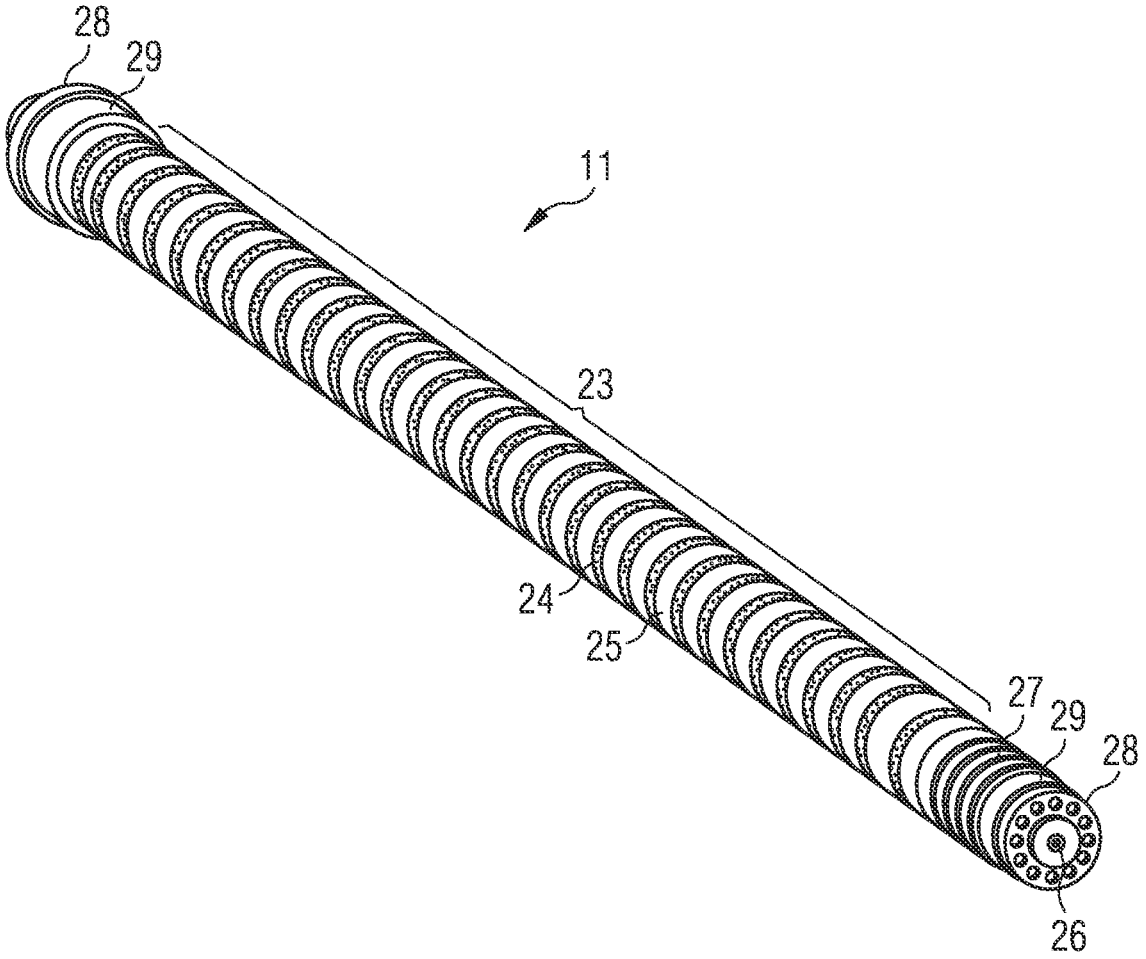
FIG. 5 provides an exemplary development of a portion of a linear rotor.

FIG. 5 shows a development of a portion of the linear rotor 11. The linear rotor 11 according to FIG. 5 comprises a magnetic portion 23, located approximately centrally and extending in the axial direction.

The magnetic portion 23 comprises a multiplicity of first permanent magnets 24 and second permanent magnets 25. The first permanent magnets 24 are permanent magnets magnetized in the axial direction, while the second permanent magnets 25 are radially magnetized permanent magnets. The first permanent magnets 24, measured in the direction parallel to the longitudinal axis L, are narrower than the second permanent magnets 25.

Disposed respectively between two adjacent permanent magnets there are shims (not shown), which are designed, in particular, to compensate production tolerances of the permanent magnets with respect to the surfaces oriented in the longitudinal direction L.

The permanent magnets 24, 25 are realized as annular disks, having a central through-hole. The linear rotor 11 has a piston rod 26, which goes through the through-holes of the permanent magnets 24, 25 and forms a central seating for the permanent magnets 24, 25.

Directly adjoining the magnetic portion 23, the linear rotor 11 has a guide sleeve 27 having a plurality of sliding guide rings. The guide sleeve 27, in particular the sliding guide rings, forms/form a part of a sliding bearing, by means of which the linear rotor 11 is mounted, or can be mounted, in the guide bushing 15 (see FIG. 3). An inner surface of the guide bushing 15 may accordingly be realized as a counter-bearing surface for the sliding guide rings.

The permanent magnets 24, 25, the shims and the guide sleeve 27 are fastened by means of clamping nuts 28 that are fastened or fixed to the piston rod 26 at both ends, and that each stop against a stop nut 29. The clamping nuts 28 and stop nuts 29, and corresponding fastening points, in particular screw thread, of the piston rod 26, and the piston rod 26 as such, are realized in such a manner that, by proper application of the stop nuts 29 and clamping nuts 28, the permanent magnets 24, 25 and the piston rod 26 are clamped to each other. In particular, in this way an improved mechanical stability, in particular of the magnetic portion 23, can be achieved.

In the assembled state, as shown in the development according to FIG. 4, the piston portion 18, the fastening structure 19 and the decoupling structure 20 may be attached to the end of the linear rotor 11 that faces away from the guide sleeve 27.

The magnetic portion 23 may have a protective coating, which may, for example, consist of an epoxy resin or comprise an epoxy resin. In particular, by means of a corresponding coating, the permanent magnets 24, 25, of the magnetic portion 23 can be protected against external influences.

Corresponding to the magnetic portions 24, 25, the stator 10 of the tubular solenoid linear motor 9, realized with the geometry of a hollow cylinder, may have ring coils 30 (see FIG. 2) that are disposed along the longitudinal direction L and spaced apart from each other. By means of an appropriate closed-loop control (not shown), the ring coils 30 can be controlled in such a manner that the magnetic portion is moved up and down in the stator, with corresponding forging motions of the ram 12 being executed.

As shown, for example, in the development according to FIG. 2, the stator 10, with the ring coils 30, can be accommodated in the modular-structure housing 32, in particular fastened therein. Owing to the approximately centrally located flanged connection 37 of the housing halves, it can be achieved that the components located inside the housing 32 can be accessed comparatively easily, for example for servicing purposes and the like.

An interface of the stator 10, or of the housing 32, by means of which the solenoid linear motor 9 is fastened to the hammer frame 2, may be realized in such a manner that the linear drive, realized as described herein, can be mounted, i.e. retrofitted, even in the case of already existing forging hammers.

In order to avoid, or at least largely prevent, any damage to the linear drive, in particular to the permanent magnets 24, 25, stop buffers 31 (see FIG. 2) may be provided on an underside of the housing base.

For the purpose of compensating pressure fluctuations that may occur inside the housing during operation of the forging hammer as a result of the motion of the linear rotor 11, the housing 32, in particular the housing wall, and/or the linear bearing arrangement 38, may have appropriate air inlet and air outlet elements.

Overall, the housing 32 may be realized in such a manner that the stator 10 and the linear rotor 11 are substantially encapsulated, in particular mechanically encapsulated, and largely protected against external influences. In particular in the case of a partial, or even complete, encapsulation, it may be necessary to provide the aforementioned pressure compensating elements.

Figure 6:
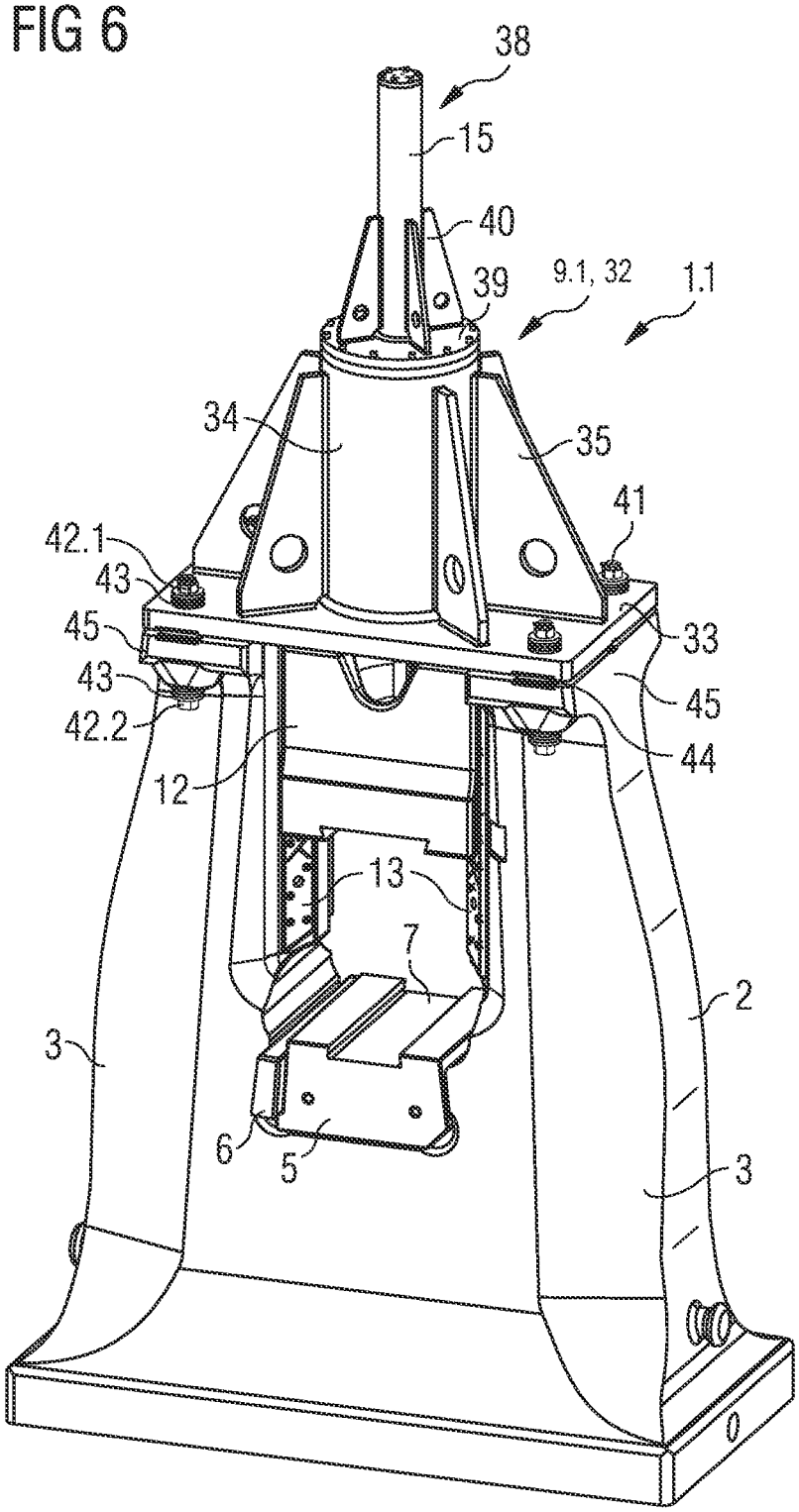
FIG. 6 provides a perspective view of a further embodiment of a forging hammer.

FIG. 6 shows a perspective view of a further development of a further forging hammer 1.1. The further forging hammer 1*a* is of a structure similar to that of the forging hammer 1 according to FIG. 1 and, unless otherwise described, elements and components denoted by the same references have equivalent and/or corresponding functions and/or properties.

Unlike the forging hammer 1 according to FIG. 1, the further forging hammer 1.1 comprises a shorter linear motor, measured in the longitudinal direction L, that is likewise realized as a solenoid linear motor, and reference is made to what in the following is referred to as a further linear motor 9.1.

Figure 7:
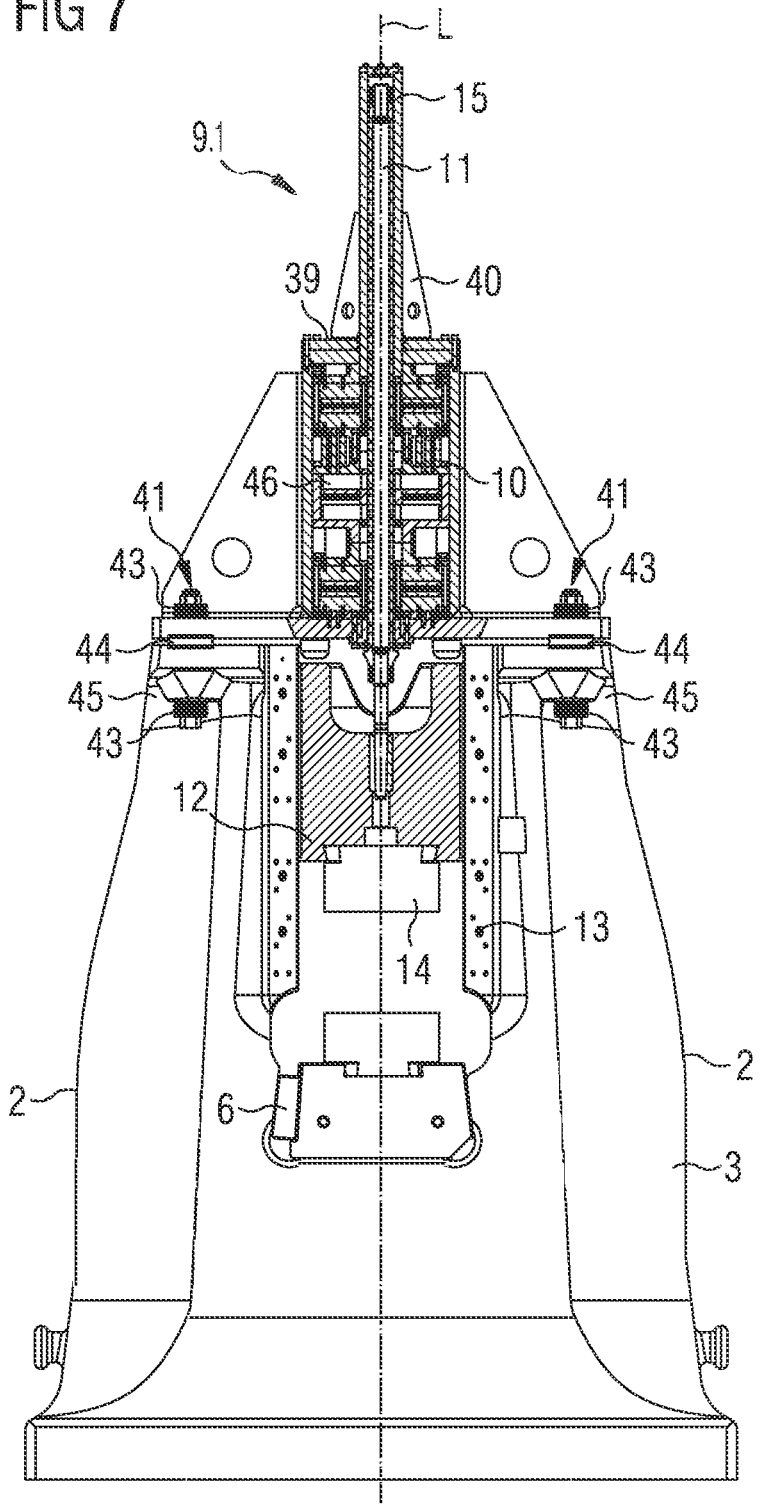
FIG. 7 provides a sectional representation of the forging hammer of the further embodiment.

The further linear motor 9.1, which is represented in section in FIG. 7, comprises a stator, which is shorted in comparison with the development according to FIG. 1 and FIG. 2. The stator of the further linear motor 9.1, measured in the longitudinal direction, may be realized, for example, so as to be half as along as that of the linear motor according to FIG. 1 and FIG. 2. In the case of the further linear motor 9.1, the linear rotor 11 may also be realized in a correspondingly shortened manner, and the magnetic portion and the portions of the linear rotor 11 adjoining the latter may be developed according to the example shown in FIG. 5.

Owing to the shortened form of the further linear motor 9.1, which is realized as a tubular linear motor, the housing 32 comprises only one housing casing 34. The one housing casing 34 is attached, in particular welded, to a housing base 33, in a manner similar to that of the development according to FIG. 1 and FIG. 2. For the purpose of reinforcement, the housing casing 34 and the housing base 33 are supported against each other via first supporting ribs 35, the first supporting ribs 35 and the housing base 33 being able to be welded to each other.

A linear bearing arrangement 38, realized as in the case of the development of FIG. 1 and FIG. 2, is attached, in particular screw-connected, to the side of the housing casing 34 that faces away from the housing base 33. The linear bearing arrangement 38 is realized in a manner corresponding to the development according to FIG. 1 to FIG. 4, and reference is made to corresponding embodiments.

In a manner similar to the development according to FIG. 1 to FIG. 4, the further linear motor 9.1, accommodated in the housing 32, is connected to the hammer frame 2 via the housing base 33.

As can be seen by jointly viewing FIG. 6 and FIG. 7, the housing base 33 is connected in a force-fitting manner to the hammer frame 2, screwed connections 41, provided at respective corners of the housing base 33, being used in the present example. A corresponding screwed connection 41 may comprise, for example, a metal-rubber bearing 43 between a screw head 42.1 and a screw nut 42.2. In addition, the housing base 33 may be mounted and fastened on carrying heads 45 of the hammer frame 2 by means of interposed damping or absorber strips 44. This structure and this manner of fastening correspond substantially to those of the forging hammer 1 according to FIG. 1 to FIG. 4.

The metal-rubber bearing 43 and/or damping or absorber strips 44 are instrumental, in particular, in the decoupling of the linear motor 9, 9.1 from the hammer frame, such that mechanical impacts, vibrations and the like that occur during forging operations can at least be weakened, such that a direct application of occurring mechanical forces to the linear motor 9, 9.1 can at least be reduced.

Yet another advantage is obtained for the further linear motor 9.1 shown in FIG. 6 and FIG. 7, since, owing to the modular design of the housing 32, the linear rotor 11, comprising, for example, a plurality of annular permanent magnets connected in succession, and also the stator 10, which, depending on the requirement, may comprise a plurality of winding bodies 46 having corresponding coil windings, in particular the structural length of the linear motor can be varied, at least with certain limits, and to that extent adapted in a comparatively flexible manner to respective requirements.

Also, not least, owing to the fact that the interface for fastening the ram, and the interface for fastening to the hammer frame can be realized so as to correspond to the conventional, hydraulically operated forging hammers, it is possible, according to the solutions proposed herein, for conventional, hydraulically operated forging hammers to be equipped, or retrofitted, with electric linear motors without the need for substantial structural design alterations, for instance to the hammer frame 2.

Overall, it is found that, by means of the solution proposed herein, in particular the use of an electric linear drive, for example a linear motor in combination with a decoupling structure, and in particular first and second linear guides, a new type of forging hammer can be provided. In particular, with the structural design proposed herein, it is possible to realize a forging hammer having a permanent-magnet-excited linear motor, provided for driving the ram, with which adequate impact forces and accelerations for the ram can be achieved, a comparatively precise position control of the ram being possible at the same time.

LIST OF REFERENCES

1 forging hammer
1.1 further forging hammer
2 hammer frame
3 column
4 crosshead
5 insert
6 insert wedge
7 receiver
8 lower hammer die
9 solenoid linear motor
9.1 further linear motor
10 stator
11 linear rotor
12 ram
13 ram guide
14 upper hammer die
15 guide bushing
16 supporting bearing
17 piston-rod extension
18 piston portion
19 fastening structure
20 decoupling structure
21 retaining bushing
22 decoupling portion
23 magnetic portion
24 first permanent magnet
25 second permanent magnet
26 piston rod
27 guide sleeve
28 clamping nut
29 stop nut
30 ring coil
31 stop buffer
32 housing
33 housing base
34 first housing casing
35 first supporting rib
36 second housing casing
37 flanged connection
28 linear bearing arrangement
39 bottom plate
40 second supporting rib
41 screwed connection
42.1 screw head
42.2 screw nut
43 metal-rubber bearing
44 damping or absorber strips
45 carrying head
46 winding body
L longitudinal axis

I claim:

1. A forging hammer, comprising:

an electric linear drive, having a linear rotor with an extension, the extension comprising a piston rod;

a ram coupled to the linear rotor, wherein the ram is configured to execute forging motions via movement of the linear rotor, wherein execution of the forging motions generates relative motions secondary to the movement of the linear rotor;

a fastening structure for fastening the ram to the extension of the linear rotor; and a decoupling structure interposed between the linear rotor and the ram, the decoupling structure comprising a flexurally elastic decoupling element disposed between the extension of the linear rotor and the fastening structure, the decoupling element having a flexural elasticity that is greater than that of the extension and the fastening structure, such that the decoupling element decouples the linear rotor from the relative motions generated by the forging motions of the ram.

2. The forging hammer as claimed in claim 1, wherein at least one of:

the relative motions generated by the forging motions of the ram include at least one of vibrations, displacements, deformations or tilting motions of the ram occurring along a longitudinal axis (L) of the linear rotor during a forging motion;

the flexurally elastic decoupling element comprises a two-dimensionally or three-dimensionally realized connecting structure having elastomechanical absorber mechanisms that are deformable in a vibrationally or torsionally elastic manner; and/or the flexurally elastic decoupling element comprises an elastomechanical damping structure.

3. The forging hammer as claimed in claim 1, wherein the flexurally elastic decoupling element:

comprises one or more decoupling regions for decoupling a relative secondary motion between the linear rotor and the ram, the secondary motion including at least one of tilting motions relative to a longitudinal axis (L) of the linear rotor, displacements transverse to the longitudinal axis (L), transverse vibrations with respect to the longitudinal axis (L);

comprises a taper in a direction transverse to the longitudinal axis (L) of the linear rotor, wherein the taper optionally has a concave curvature realized in a cross section along the longitudinal axis (L) of the linear rotor;

comprises a plurality of cross-sectional surfaces transverse to the longitudinal axis (L), the plurality of cross-sectional surfaces having surfaces areas that are selectively varied; and is one of:

(i) configured as a single piece with the linear rotor, the piston rod having an end facing the ram, the flexurally elastic decoupling element positioned at the end of the piston rod; or (ii) configured as a separate structural element, and is connected to the linear rotor in at least one of a form-fitting, materially bonded and/or force-fitting manner.

4. The forging hammer as claimed in claim 1, the electric linear drive comprising a stator, and the forging hammer further comprising a first linear guide positioned between the stator of the electric linear drive and the ram, in which the linear rotor is guided in a longitudinal direction (L), wherein at least one of:

the first linear guide comprises one of a rolling bearing, a sliding-contact bearing, a sliding bushing, or a guide bushing;

the first linear guide is positioned about a supporting structure for the electric linear drive; and a length of the first linear guide, measured parallel to the longitudinal direction (L) of the linear rotor, is at least as great as one times a diameter of the linear rotor.

5. The forging hammer as claimed in claim 4, further comprising:

a second linear guide on a side of the electric linear drive that: (i) faces away from the ram, (ii) guides the linear rotor in the longitudinal direction (L), and (iii) is supported transversely to the longitudinal direction (L);

wherein at least one of:

the second linear guide comprises a bearing or a guide bushing including a bushing or sleeve closed on one side;

a length of the second linear guide, measured parallel to the longitudinal direction (L), is at least as great as one times a diameter of the linear rotor;

the second linear guide is fastened about one or both of: (i) a housing structure, and (ii) the stator of the electric linear drive; and the second linear guide is positioned about a supporting structure for a linear motor of the electric linear drive.

6. The forging hammer as claimed in claim 5, wherein the linear rotor, the first and the second linear guide are configured such that the linear rotor is always guided and supported, both in the first and in the second linear guide, over an entire linear motion cycle of the linear rotor.

7. The forging hammer as claimed in claim 5, further comprising:

a housing base, wherein a first linear guide is positioned about the housing base, and is at least partially fixed in a through-bore of the housing base, wherein the through-bore is in axial alignment with a rotor space of the linear motor, such that the movement of the linear rotor occurs at least partially inside of the through-bore; and wherein a sliding-contact bearing structure of the first linear guide is disposed so as to extend circumferentially along the through-bore, such that the sliding-contact bearing structure provides a passage opening for the linear rotor that is concentric with the through-bore.

8. The forging hammer as claimed in claim 7, wherein:

the second linear guide is positioned about an end face that faces away from the first linear guide, and at an end face of the stator, or of a housing structure that faces away from the housing base;

the second linear guide comprises a guide cylinder provided with an external supporting structure, and wherein the guide cylinder is attached to a guide plate comprising supporting ribs connecting the guide plate and the guide cylinder;

supporting walls extend from the housing base and connect to the guide plate, the guide plate running on laterally opposite sides of the stator and parallel to the longitudinal direction (L), and the housing base is connected to a carrying frame of the forging hammer by screwed connections provided at respective corners of the housing base.

9. The forging hammer as claimed in claim 1, wherein:

one or both of: (i) at least a region of the linear rotor, and (ii) the decoupling structure have/has a cylinder structure; and a ratio of a diameter of the cylinder structure to one of a diameter, a length, or a width of the ram is in a range of between 1/10 and 1/4.

10. The forging hammer as claimed in claim 9, wherein a ratio of a diameter of the cylinder structure to a length of the decoupling structure between the linear rotor and the ram is in the range of between 1/5 and 1/2.

11. The forging hammer as claimed in claim 1, wherein a ratio of a diameter of the decoupling structure, measured transversely to a longitudinal axis (L) of the linear rotor, to a diameter of the linear rotor, or of the piston rod of the linear rotor, is in the range of between 0.85 and 0.97.

12. The forging hammer as claimed in claim 1, wherein the electric linear drive comprises a stator, and wherein an axial length of the linear rotor is greater than an axial length of the stator of the electric linear drive measured along a longitudinal axis (L) of the linear rotor.

13. The forging hammer as claimed in claim 1, wherein:

the decoupling structure is positioned between the linear rotor, or a spur adjoining the linear rotor, and the fastening structure; and the fastening structure comprises a wedge segment or a conical segment connected in a form-fitting or frictional manner to the ram.

14. The forging hammer as claimed in claim 1, wherein the electric linear drive further comprises a permanent-magnet-excited synchronous linear motor.

15. The forging hammer as claimed in claim 1, further comprising:

a housing structure for an electric linear motor of the electric linear drive, wherein a housing structure:

has a housing base on which a stator of the linear motor is fixed and supported; and comprises, on a side that faces toward the ram, one or more stop buffers that are positioned to buffer mechanical loads on the linear motor caused by collisions between the ram and the housing structure during operation of the forging hammer.

16. A forging hammer, comprising:

an electric linear drive having a linear rotor, the linear rotor comprising a piston rod; and a ram coupled to the linear rotor;

wherein:

the linear rotor comprises a magnetic portion, extending in an axial direction (L), the magnetic portion comprising a plurality of permanent magnets disposed in succession in the axial direction;

the permanent magnets are comprised of magnetic annular disks; and the permanent magnets are fixed by fastening elements placed on opposing sides of the magnetic portion and attached to the piston rod of the linear rotor that passes through the magnetic annular disks.

17. The forging hammer as claimed in claim 16, wherein:

the permanent magnets are magnetized alternately radially and axially in succession in the axial direction (L);

laminated shims are disposed between axially succeeding permanent magnets; and the permanent magnets are made from a neodymium-iron-boron (NdFeB) material.

18. The forging hammer as claimed in claim 16, wherein one of:

(i) the electric linear drive is configured as a tubular linear motor; or (ii) a decoupling structure is positioned about a cylindrical spur that adjoins an extension of the magnetic portion of the linear rotor.

19. The forging hammer as claimed in claim 16, wherein:

the linear rotor comprises a guide sleeve in a region adjacent to the magnetic portion;

the guide sleeve comprises at least one sliding guide ring; and a stop sleeve is positioned at an end of the magnetic portion that is opposite from the guide sleeve.

20. The forging hammer as claimed in claim 19, wherein:

an outer surface of the guide sleeve forms a bearing surface, by means of which the linear rotor is movably mounted within a linear guide of the forging hammer, such that the linear rotor is movable in the axial direction (L) in the linear guide, and the guide sleeve is configured to support the linear rotor in a sliding manner with the outer surface of the guide sleeve in cooperation with an inner surface of the linear guide.

* * * * *